US005421508A

United States Patent [19]

Beales

[11] Patent Number: 5,421,508

[45] Date of Patent: Jun. 6, 1995

[54] SANDWICH HOLDER

[75] Inventor: Jonathan T. Beales, Memphis, Tenn.

[73] Assignee: International Paper Company, Purchase, N.Y.

[21] Appl. No.: 336,126

[22] Filed: Nov. 4, 1994

[51] Int. Cl.[6] ..... B65D 5/42

[52] U.S. Cl. ..... 229/107; 248/174; 229/902; 229/938

[58] Field of Search ..... 229/107, 902, 906, 938; 206/216, 541; 248/152, 174, 459

[56] References Cited

U.S. PATENT DOCUMENTS

| | | | |
|---|---|---|---|
| D. 310,462 | 9/1990 | Schoen . | |
| 1,945,397 | 1/1934 | Gray | 229/906 |
| 3,446,416 | 5/1969 | Epstein . | |
| 3,610,512 | 10/1971 | Hermalun | 229/902 |
| 3,744,707 | 7/1973 | Ross . | |
| 3,758,017 | 9/1973 | Ross . | |
| 4,251,552 | 2/1981 | Uno et al. . | |
| 4,509,674 | 4/1985 | Levick . | |
| 4,573,570 | 3/1986 | Cortopassi . | |
| 4,589,619 | 5/1986 | Forbes, Jr. | 248/174 |
| 4,603,825 | 8/1986 | Kotlkiar . | |
| 4,760,950 | 8/1988 | Levick . | |
| 4,763,832 | 8/1988 | Forbes, Jr. | 229/902 |
| 4,938,515 | 7/1990 | Fazio . | |
| 5,036,980 | 8/1991 | Vigue et al. | 229/938 |

*Primary Examiner*—Gary E. Elkins
*Attorney, Agent, or Firm*—Michael J. Doyle

[57] ABSTRACT

A folded wrapper for a food product such as a taco or sandwich, the wrapper formed from a unitary circular blank of paperboard. In order to accommodate the thickness of the food product without squeezing it, the wrapper is provided with two major parallel fold lines at a generally diametrical fold location. The spacing between these lines is generally that of the thickness of the food product. When folded however about these fold lines, the wrapper would fold about only one or the other of them, thereby squeezing the product. Further, the ends of the folds would be open and thus permit pastes of other semi-liquid or liquid components of the product to escape. To seal the ends of the fold, and also to prevent folding about only one of the major parallel pairs of fold lines, the major parallel fold lines are shortened and a pair of shorter fold lines, located midway of the parallel fold lines and extending radially inwardly from the wrapper periphery, are provided. The wrapper is releasably latched at the peripheries of the two folded halves by interengaging ears and slots.

7 Claims, 2 Drawing Sheets

FIG. 1
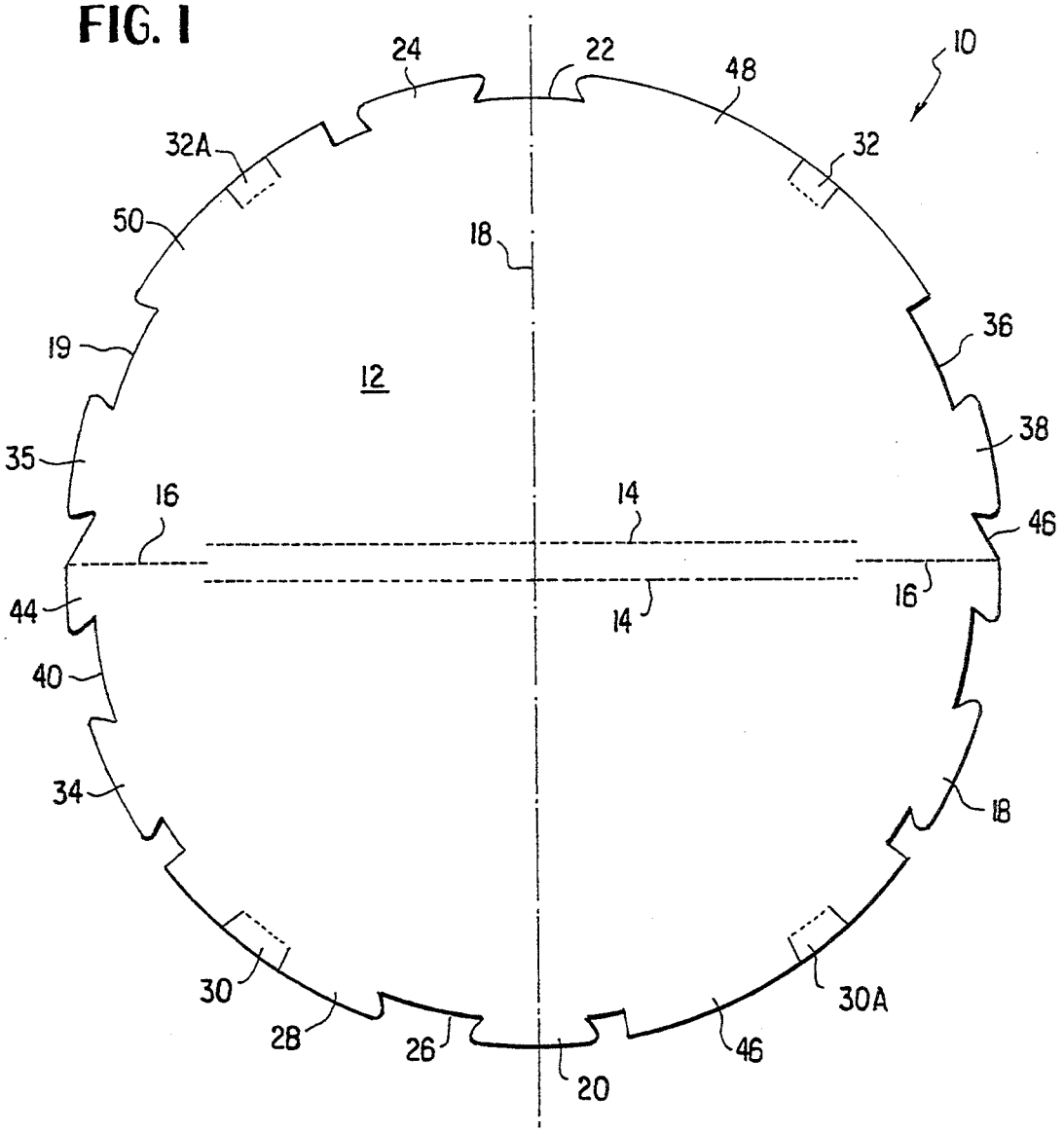
FIG. 4
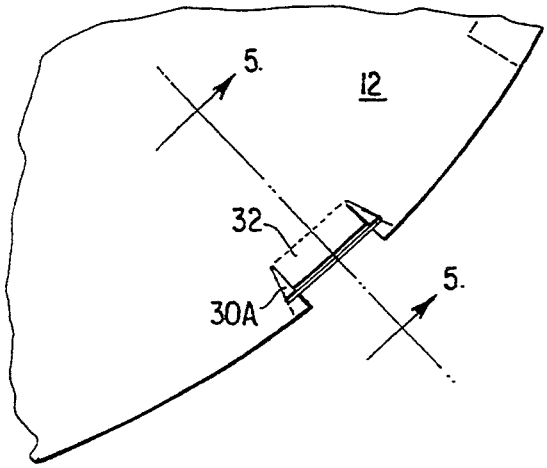
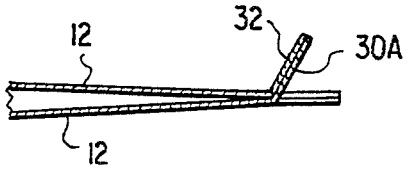
FIG 5

SANDWICH HOLDER

BACKGROUND OF THE INVENTION

This invention relates to a sandwich wrapper or holder fashioned from paperboard or other stiff, foldable and resilient sheet material. Sandwich holders fashioned of paperboard or the like are known, as shown in U.S. Pat. Nos. 3,446,416 issued to Epstein and 4,603,825 issued to Kotliar. Both of these constructions relate to substantially U-shaped members for holding a sandwich or a taco.

However, there exists a need in the packaging field for a sandwich holder which can function as a sanitary surface upon which to make a sandwich, and which can also be used as a holder or carrier to transport the sandwich securely, and which also can be used as a placemat to eat off of.

SUMMARY OF THE INVENTION

According to the practice of this invention, a generally circular sandwich or taco card is fashioned from paperboard and is provided with score lines permitting it to be diametrically folded about a diameter. The circumference or periphery of the card is provided with a plurality of teeth and slots, defining a somewhat castellated arrangement, with the action being such that after a sandwich is made and placed within the card or holder, the card is folded about a diameter to form a semicircular holder, with the curved edges of the holder being interlocked to thereby secure it in a closed configuration. The holder is easily openable and then serves, as noted above, as a placemat upon which to place the sandwich or taco during its consumption by a user.

A pair of radially inwardly extending fold lines, coincident with a diameter but of lesser total length than this diameter, are located at the periphery of the blank and a pair of parallel fold lines are located on respective opposite sides of this diameter and extend across the major portion of the central part of the blank. This arrangement of fold lines assures that when folded, the blank will fold about both of the parallel fold lines, instead of about only one of them, to produce a spacing between the folded blank halves, the spacing accommodating a sandwich without squeezing and distorting it.

BRIEF DESCRIPTION OF THE DRAWINGS

FIG. 1 is a plan view of a blank fashioned of paperboard from which the holder of this invention is fashioned.

FIG. 4 is a partial plan view of the folded holder as illustrated at FIG. 2.

FIG. 5 is a view taken along section 5—5 of FIG. 4.

DETAILED DESCRIPTION OF THE INVENTION

Figure 2:
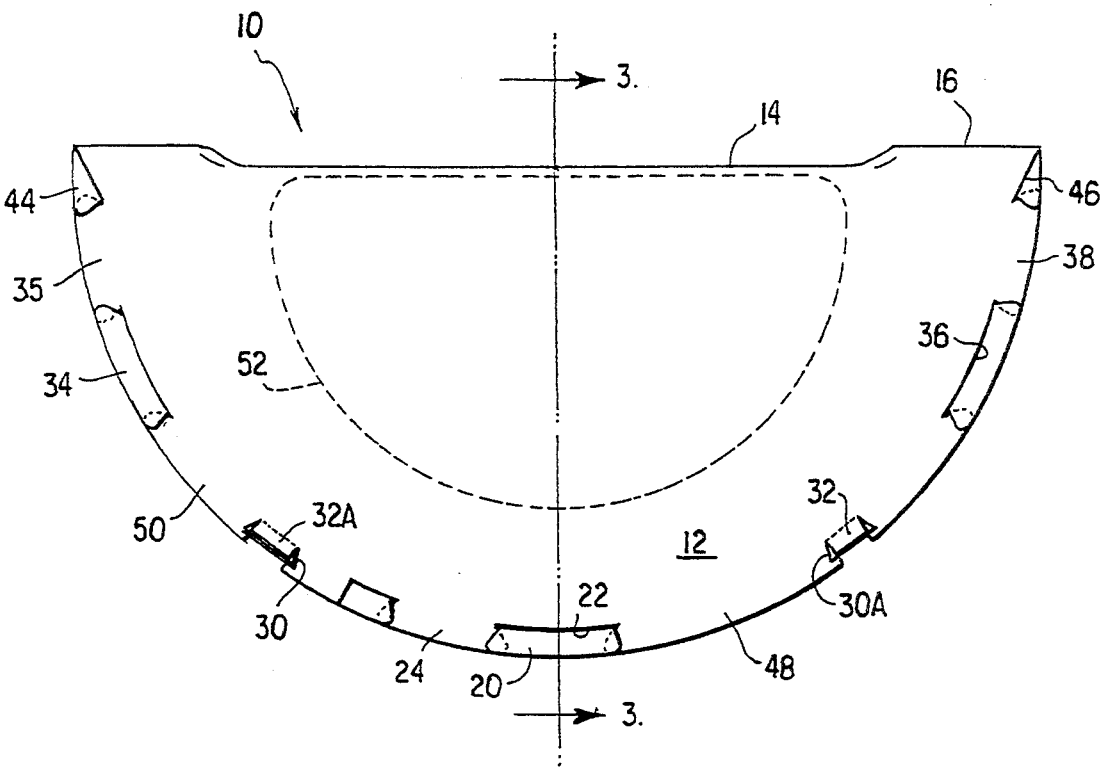
FIG. 2 is a view illustrating the holder of FIG. 1 after it has been folded about a diameter and its curved periphery releasably latched together to secure a sandwich or other food item therein.

Referring now to FIG. 1, a unitary and generally circular paperboard blank is denoted as 10 as defined by a single layer of paperboard 12. Major fold lines 14 extend horizontally for the major extent of the diameter of the blank, with additional fold lines 16 of lesser length being parallel to fold lines 14. Fold lines 16 extend from the circumference or periphery of the blank radially inwardly, with fold lines 14 and 16 being at right angles to a vertical axis 18 of the blank. Fold lines 16 are preferably coincident with a diameter of the blank, while fold lines 14 are spaced from this diameter and would be chords if extended to the blank periphery.

The lower periphery of the blank, with the term lower referring to the lowest part of FIG. 1, is provided with an ear 20 which is diametrically opposite to a complementary slot 22 at the top of the blank. In the upper left-hand quadrant of panel 12, an ear 24 is provided, with ear 24 being complementary to slot 26 at the lower left quadrant of the blank. The lower left quadrant of the blank is also provided with an elongated ear 28, the latter having an intermediate foldable tab 30 substantially centrally thereof as measured along its periphery. Similarly, the upper left quadrant of blank 10 is provided with an ear 50 having a tab 32A therealong, the tab defined by spaced and radially extending cut lines. The lower right-hand quadrant is provided with an ear 46 having tab 30A along its length. Ear 48 is positioned in the upper right-hand quadrant and is provided with a tab 32. The lower right-hand quadrant also includes an ear 18 which is generally complementary to recess slot 36 in the upper right-hand quadrant. The lower right-hand portion of upper right quadrant is provided with a slot 46 adjacent one end of one fold line 16, with the leftmost portion of upper left-hand quadrant provided with a similar but unnumbered slot. The upper right-hand quadrant is provided with an ear 38 located between recesses or slots 46 and 36. The lower left quadrant is provided with spaced ears 34 and 44, with recess or slot 40 positioned therebetween. The upper left quadrant is provided near its lowermost portion with ear 35, with slot 19 positioned between ears 35 and 50.

It will be noted that the widest part of each ear is longer, measured circumferentially, than the narrowest part of its corresponding slot or recess, also measured circumferentially. Thus the widest part of ear 34 is of greater extent that the narrowest part of slot 19. The same relation holds for ear 18 and its corresponding slot 36, and for ear 20 and its corresponding slot 22, and for ear 24 and its corresponding slot 26.

Referring now to FIG. 2 of the drawings, a sandwich, taco, or other food item, denoted as 52 by dashed lines, may be made on one surface of paperboard 10, or alternatively, may be made some other place, and is placed beneath lowermost fold line 14 of FIG. 1. Then, the upper two quadrants are folded over and towards the reader about diametrical fold lines 16 and both major fold lines 14. The now coincident semicircular respective peripheries of the upper and lower halves of the blank are latched together. This latching is effected in the following manner. In general, the edges of the several peripheral ears are bent behind corresponding ends of the several slots or recesses in the periphery of the blank. Thus, referring again to FIG. 2, the lowermost end of ear 44 is pushed back beyond the plane of tongue 35, so that tip extends past the surface of ear 35. Similarly, ear 34 is pushed upwardly through slot or recess 19 so that the peripherally or circumferentially spaced ends of ear 34 pass beyond the edges of slot 19 and now lie on the top surface of the upper half of the blank, as viewed at FIG. 2. In FIG. 2, the reader will observe that the ends of ear 34 are shown in solid lines, while the ends of slot 19 are shown in dashed lines, thus denoting that the ends of ear 34 are above the plane of upper half of the blank. Again referring to FIG. 2, it is seen that a similar action takes place with respect to the ends of tongue 20 and slot 22. Namely, the circumferentially spaced ends of ear 20 are pushed beyond the peripherally spaced edges or ends of slot or recess 22 and lie above the plane of the upper semicircular half of the blank. Referring now to the right-hand portion of FIG. 2, the ends of ear 18 are pushed upwardly so as to engage on top of the circumferentially spaced ends of slot 36. FIG. 2 also shows that after folding about the horizontal diametrical portion of the blank, tabs 30A and 32 are in substantial registry, as are tabs 32A and 30. Tabs 30 and 30A are slightly wider than tabs 32A and 32 so that pushing the former through the slots defined by the latter results in a resilient latching action. This is shown at FIGS. 4 and 5.

Figure 3:
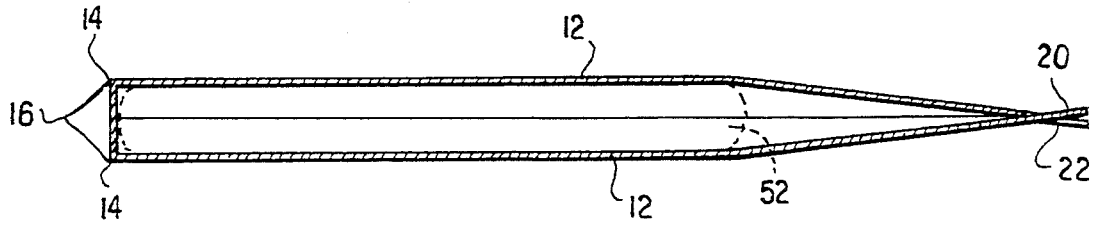
FIG. 3 is a view taken along section 3—3 of FIG. 2.

FIG. 3 illustrates the folding action produced by the lines 14 and 16. With fold lines 14 and 16, the blank will fold about both parallel lines 14 for substantially their entire extent, as seen at FIGS. 2 and 3. Without lines 16, and with lines 14 extended to the periphery, the blank would fold about one or the other of lines 14, but not about both. Further, the two semicircular peripheries would not be coincident or superposed so as to permit latching of the ears and slots. The thickness of the wrapper at the fold area would then be merely twice the thickness of the paperboard, with no space to accommodate the thickness of the food product. The shown relation of fold lines 14 and 16 produces a spacing for accommodating the food product at the center of the folded wrapper without squeezing or distorting the food product, as shown at FIG. 3, with lines 16 at the ends of the fold zone closing this central spacing. Lines 14 and 16 thus define a fold zone, as opposed to a single fold line. A pocket or space for the food product is thus defined by the distance between spaced lines 14, the ends 16 at the fold zone, and the engaged peripheral ears and slots. Lines 16, coincident with a diameter of the blank 10, define a first fold axis while lines 14 define respective second and third fold axes since, as seen from FIGS. 2 and 3, folding of the two halves takes place along three different fold axes. FIGS. 1 and 2 show that the ends of fold lines 14 terminate near the innermost ends of fold lines 16.

Tabs 30, 30A, 32A, and 32 may carry indicia to indicate product within the wrapper, with these tabs being optional.

The fold zone defining action of lines 14 and 16 described above are is not limited to a circular blank for forming the wrapper or holder. Nor are the peripheral and releasably latching ears and slots limited to the illustrated circular blank construction, although the latter is preferred. The blank may be rectangular, oval, or other desired regular form, so that upon folding about the fold zone, the peripheries of the two folded halves will substantially coincide to permit releasable latching by the ears and slots. This peripheral coincidence will result if the blank is substantially mirror symmetrical about the fold zone defined by fold lines 14 and 16.

I claim:

1. A unitary blank of paperboard for forming a sandwich wrapper, said blank being substantially mirror symmetrical about a first fold axis, said first fold axis including a first pair of collinear fold lines each extending from the blank periphery radially inwardly and being collinear, a second pair of fold lines being parallel to said first pair of fold lines and parallel to each other, each of said second fold lines being displaced from said first fold axis and on respective opposite sides of said first fold axis, each of said second fold lines defining its own fold axis to thereby define respective second and third fold axes, said first, second, and third fold axes defining two halves of said blank, ends of said second and third fold lines terminating adjacent radially innermost ends of said first collinear fold lines, each said blank half having a periphery, each of said peripheries of said two halves of said blank having means for releasably latching them together, whereby upon folding said two blank halves a space for a food product is defined by said second and third fold axes and whereby said first fold axis and said means for releasably latching said peripheries closes said space.

2. The blank of claim 1 wherein said blank is circular and wherein said first fold axis is coincident with a diameter of said blank.

3. The blank of claim 1 wherein said means for releasably latching said peripheries together is defined by a series of mutually engagable ears and slots on said peripheries.

4. A wrapper for a food product, said wrapper formed from a unitary blank of paperboard, said wrapper having two substantially identical halves folded together about three fold axes at a fold zone, a first fold axis of said three fold axes defined by two spaced apart and collinear fold lines each of which extends inwardly from respective opposite edge portions of said wrapper, said second and third fold axes defined by two parallel fold lines each of which is on a respective opposite lateral side of said collinear first fold lines and parallel thereto, said second and third fold lines extending across the major portion of said fold zone, said two halves each having respective aligned peripheries which are releasably latched together, whereby a space for a food product is defined within said folded wrapper.

5. The wrapper of claim 4 wherein said second and third fold lines terminate adjacent respective ends of said first fold lines.

6. The wrapper of claim 4 wherein said unitary blank is substantially circular and wherein said first fold lines lie on a diameter of said blank.

7. The wrapper of claim 4 wherein said peripheries are releasably latched together by mating ears and slots.

* * * * *